US006604924B2

(12) United States Patent
Schneider et al.

(10) Patent No.: US 6,604,924 B2
(45) Date of Patent: Aug. 12, 2003

(54) POSITIVE-DISPLACEMENT PUMP

(75) Inventors: Willi Schneider, Bad Neustadt (DE); Peter Jeschonnek, Feldkirchen-Westerham (DE); Reiner Schmid, München (DE)

(73) Assignees: Joma-Hydromechanic GmbH, Bodelshausen (DE); Bayerische Motorenwerke Aktiengesellschaft, Munich (DE)

( * ) Notice: Subject to any disclaimer, the term of this patent is extended or adjusted under 35 U.S.C. 154(b) by 0 days.

(21) Appl. No.: 09/808,304

(22) Filed: Mar. 14, 2001

(65) Prior Publication Data

US 2002/0136656 A1 Sep. 26, 2002

(30) Foreign Application Priority Data

Mar. 15, 2000 (DE) ..... 100 12 406
Nov. 7, 2000 (DE) ..... 200 18 958 U

(51) Int. Cl.[7] ..... F04C 2/344
(52) U.S. Cl. ..... 418/258; 418/148
(58) Field of Search ..... 418/147, 148, 418/258

(56) References Cited

U.S. PATENT DOCUMENTS 620,636 A * 3/1899 Berg ..... 418/258
884,747 A * 4/1908 Macnish ..... 418/258
1,078,301 A * 11/1913 Moore ..... 418/148
1,528,075 A * 3/1925 Richer ..... 418/258
1,658,524 A * 2/1928 Gurley ..... 418/147
1,972,864 A * 9/1934 Bradshaw ..... 418/258
2,436,876 A * 3/1948 Stamsvik ..... 418/258
3,386,648 A * 6/1968 Van Rossem ..... 418/258
3,452,725 A * 7/1969 Kelly ..... 418/147

FOREIGN PATENT DOCUMENTS

DE 3628998 * 3/1988 ..... 418/258
FR 590546 * 3/1925 ..... 418/258
GB 605740 * 7/1948 ..... 418/258
JP 52-16011 * 2/1977 ..... 418/258
JP 55-98689 * 7/1980 ..... 418/148
JP 62-126286 * 6/1987 ..... 418/148

* cited by examiner

*Primary Examiner*—John J. Vrablik
(74) *Attorney, Agent, or Firm*—Rader, Fishman & Grauer PLLC

(57) ABSTRACT

A positive-displacement pump including a rotating vane disposed within a pump housing. The rotating vane is driven by a rotating drive shaft and the rotating vane is radially displaceable relative to the drive shaft wherein the ends of the rotating vane carry sealing strips that adjoin an inner wall of the pump housing. At least one energy storage device is included for engaging the vane and holding the sealing strips in sealing contact with the housing.

7 Claims, 6 Drawing Sheets

POSITIVE-DISPLACEMENT PUMP

TECHNICAL FIELD

The invention generally relates to pumps, and more particularly relates to a positive-displacement pump with a vane for mutually separating the two chambers in the interior of the pump housing.

BACKGROUND OF THE INVENTION

A positive-displacement pump of this type is already known from FIG. 2A of DE 41 07 720 A1. In this case, both end faces of the vane that separates the two chambers of the pump housing interior from one another and is guided in a restricted fashion respectively carry one sealing strip that is movably guided in the longitudinal direction of the vane and adjoins the inner circumferential wall of the housing interior.

In order to realize this movable arrangement of the sealing strips, they are realized with a T-shaped cross section, with the cross section of the outside of the T-bar being convexly curved and consequently contacting the circumferential wall along only one surface line.

The central web of the strip is engaged with a longitudinal groove machined into the end face of the vane such that it can be moved in the longitudinal direction of the vane, so that the sealing strips automatically adjoin the inner circumferential wall of the housing when the drive shaft rotates due to the effect of centrifugal force.

The disadvantage of this construction can be seen in the fact that the sealing strips only adjoin the inner circumferential wall of the housing interior in a sealing fashion due to the centrifugal force once a certain rotational speed of the drive shaft is reached. This means that a chamber seal which ensures a reliable transport of the gaseous or aqueous medium is not realized until this time.

Positive-displacement pumps of this type consequently are, for example, not suitable for evacuating a brake booster of a motor vehicle since an evacuation needs to be ensured at slow rotational speeds in this case.

The present invention is based on the objective of disclosing a positive-displacement pump, in which a transport of the respective medium starts at a rotational speed>0 or when the centrifugal force during the start of the motor-driven pump does not yet suffice for displacing the sealing strips of the vane into their maximum radial sealing position.

Due to the fact that the vane is equipped with an energy storing device, a permanent contact of both sealing strips with the circumferential wall of the housing interior is also ensured while the shaft is at a standstill, so that the respective medium is displaced or transported at the beginning of the shaft rotation.

In this context, it should be mentioned that FIG. 4 of DE 41 07 720 A1, which was cited above with reference to the state of the art, discloses a pump construction, in which the vane is already equipped with energy storing devices in the form of compression springs. In contrast to the construction according to the invention, the sealing strips are immovably held on the vane ends, i.e., the compression springs do not serve for holding the sealing strip in constant contact with the inner circumferential wall of the housing interior, but rather for supporting the end of the vane that moves into the lower dead center in the oval housing interior in order to compensate for the effects of centrifugal force (see column 5, lines 5 ff.).

According to one advantageous embodiment of the invention, the vane may be guided such that it can be radially displaced on the drive shaft or in a pump rotor that is driven by said drive shaft. In this case, it may, as mentioned above, already suffice to merely arrange one energy storing device between the vane and one of its sealing strips. However, it is preferred to arrange both sealing strips such that they can be moved in the longitudinal direction of the vane, with both sealing strips being supported by one respective energy storing device.

The movable arrangement of the sealing strips may be realized in accordance with FIG. 2A of DE 41 07 720 A1. In this case, the energy storing devices may be respectively arranged between the base of the vane groove and the web of the T-shaped cross section of the sealing strips.

One preferred arrangement of the movable sealing strips on the vane makes it possible to eliminate mold slides for forming guide grooves on the end face of the slide vane as well as on the strip during the injection molding of the vane and the sealing strips. In addition, the sealing strips that are attached to or overlap the vane end in this construction have a higher stability because the bending moments during the vane rotation which result from radial support forces can be favorably absorbed by the U-limbs of the sealing strips.

The energy storing device that is realized in the form of a leaf spring can be advantageously positioned such that the vane and the sealing strips simultaneously remain exactly aligned relative to one another in the lateral direction.

An alternative arrangement of the energy storing device is disclosed wherein this construction is primarily advantageous if the interior of the pump housing has a shape that highly deviates from a circular cylindrical circumference and the sealing strip or strips need to be displaced by relatively large radial distances during the rotation of the vane.

Another advantageous vane construction is disclosed wherein the sealing strips are arranged on the vane ends such that they can be moved in the longitudinal direction of the vane.

It should also be mentioned that the invention can be utilized in an equally advantageous fashion on the vane of vane-cell pumps.

DETAILED DESCRIPTION OF THE PREFERRED EMBODIMENTS

Figure 1:
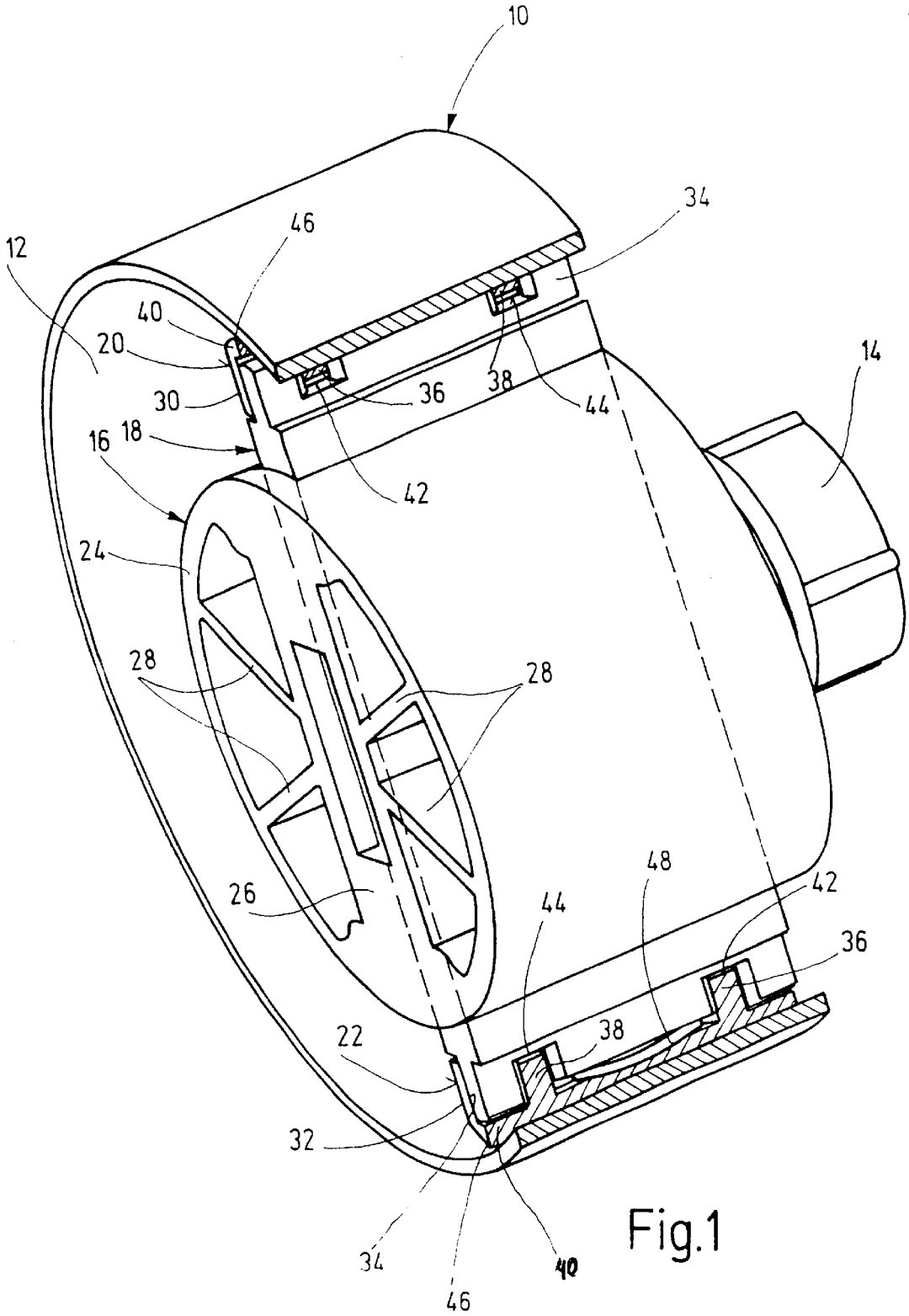
FIG. 1, a partially sectioned representation of a positive-displacement pump with a pump rotor that contains a vane realized in accordance with the invention.
Figure 2:
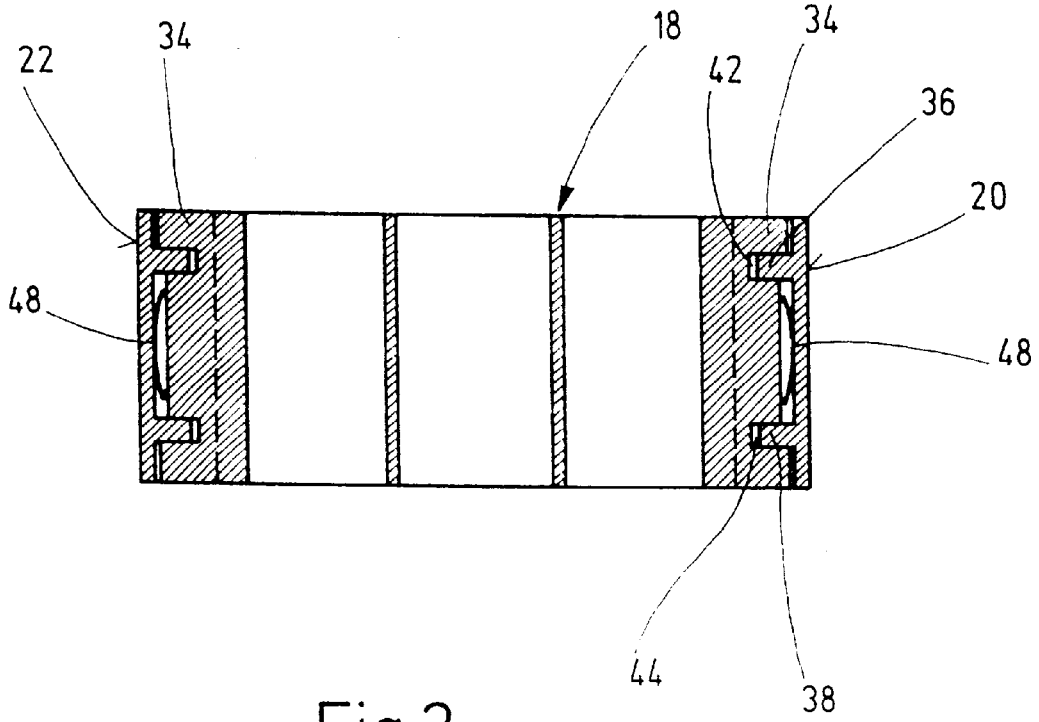
FIG. 2, a longitudinal section through the rotor vane according to FIG. 1.

The positive-displacement pump according to FIG. 1 conventionally contains a pump housing 10, a pump rotor 16 that is eccentrically arranged in the, for example, circular cylindrical interior 12 of the pump housing and connected to the drive shaft 14 in a rotationally rigid fashion as well as a rotor vane 18 that is guided in a radially movable fashion in said pump rotor and carries one respective sealing strip 20 and 22 on its vane ends.

The pump rotor 16 preferably contains a hollow cylindrical rotor casing 24, in which an inner vane guide strip 26 that extends along its inside diameter is provided. The rotor vane 18 is accommodated in this vane guide strip such that it can be radially displaced. The reference symbol 28 identifies inner rotor webs for reinforcing the rotary casing. The rotor 16 is slotted toward the drive shaft 14 in order to guide the vane 18 and attached, inserted or integrally injection-molded into/onto the shaft 14.

Although not shown in the figures, the housing interior 12 is tightly sealed on both end faces, with the drive shaft 14 extending through one end face of the housing in a fluid-tight fashion. An inlet line and an outlet line are also connected to the housing interior 12 in order to supply and discharge a medium to be conveyed by the positive-displacement pump.

The sealing strips 20, 22 of the rotor vane 18 preferably have a U-shaped cross section, with the U-limbs 30, 32 respectively overlapping a guide web 34 that preferably is integrally formed onto the vane end faces over the entire width of the vane. In order to achieve an exactly linear relative movement of the sealing strips 20, 22 in the longitudinal direction of the rotor vane 18, the sealing strips are preferably equipped with two guide elements 36, 38 that are laterally spaced apart and extend parallel to one another. These guide elements are integrally formed onto the spine 40 that connects the U-limbs 30, 32 and extend parallel thereto, with the length of said guide elements preferably being smaller than that of the U-limbs 30, 32.

The guide elements 36, 38 respectively engage depressions 42 and 44 that are realized similar to blind holes and thusly also ensure an exact alignment of the sealing strips 20, 22 perpendicular to the longitudinal direction of the vane.

The spine 40 of the sealing strips 20, 22 which connects the U-limbs preferably has such a cross section that it simultaneously defines a sealing edge 46 on the outer side. In order to constantly hold this sealing edge in a sealing contact with the inner circumferential wall of the housing interior 12, an energy storing device that is preferably realized in the form of a leaf spring 48 is provided between the guide web 34 of the vane and the spine 40 of the strip. This energy storing device constantly displaces the respective sealing strip 20 or 22 in the direction of the inner circumferential wall of the housing interior 12 and holds the respective sealing strip in contact with this inner circumferential wall.

Figure 3:
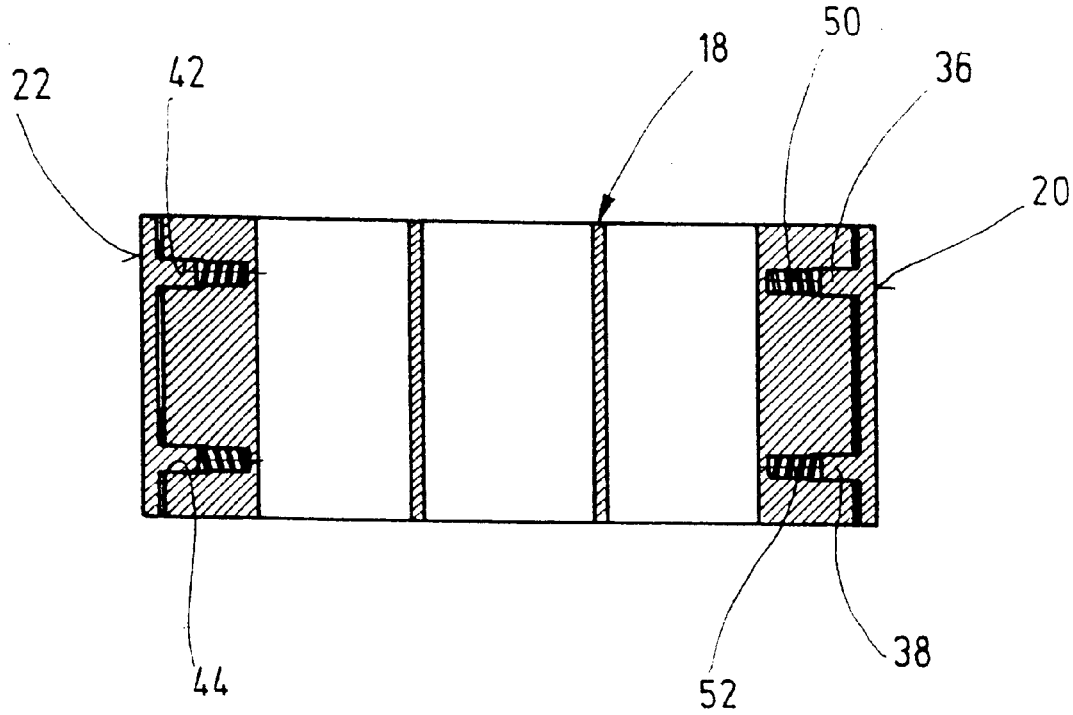
FIG. 3, a longitudinal section through one variation of the rotor vane.
Figure 4:
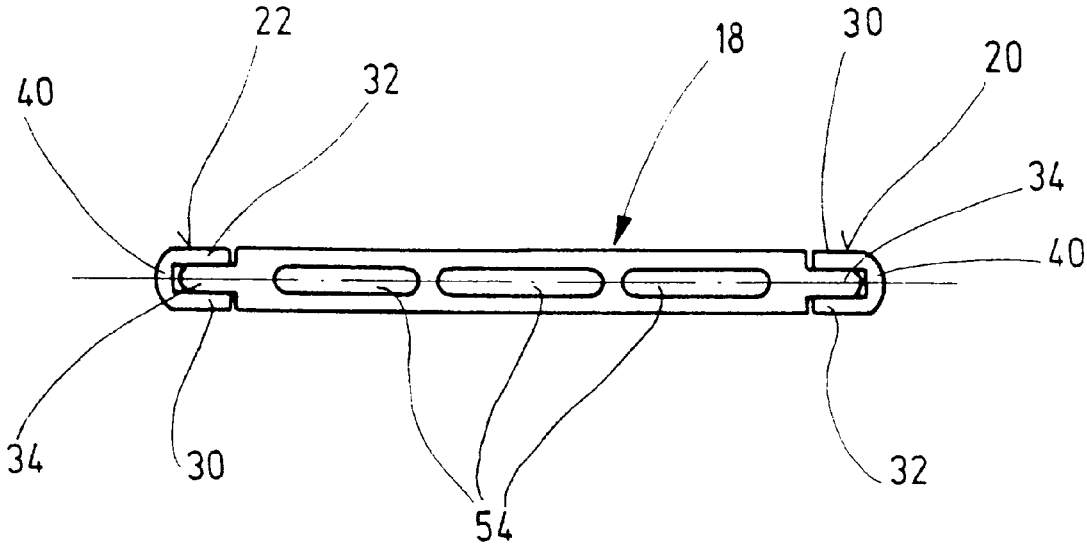
FIG. 4, a view of a longitudinal vane edge.

In an alternative variation, one respective compression spring 50 and 52 may, for example, be arranged in each depression 42, 44, with the strip guide elements 36, 38 being supported on said compression springs (FIG. 3).

The rotor vane 18 as well as the sealing strips 20, 22 are preferably realized in the form of injection-molded plastic parts, with the rotor vane 18 being provided, for example, with three recesses 54 that are realized in the form of flat slots and transversely extend through the rotor vane parallel to its flat sides, in particular, to achieve a uniform material distribution during the injection molding process. The pump rotor 16 may also be centrally arranged in the housing interior 12 if the latter has an oval circumferential shape.

Figure 5:
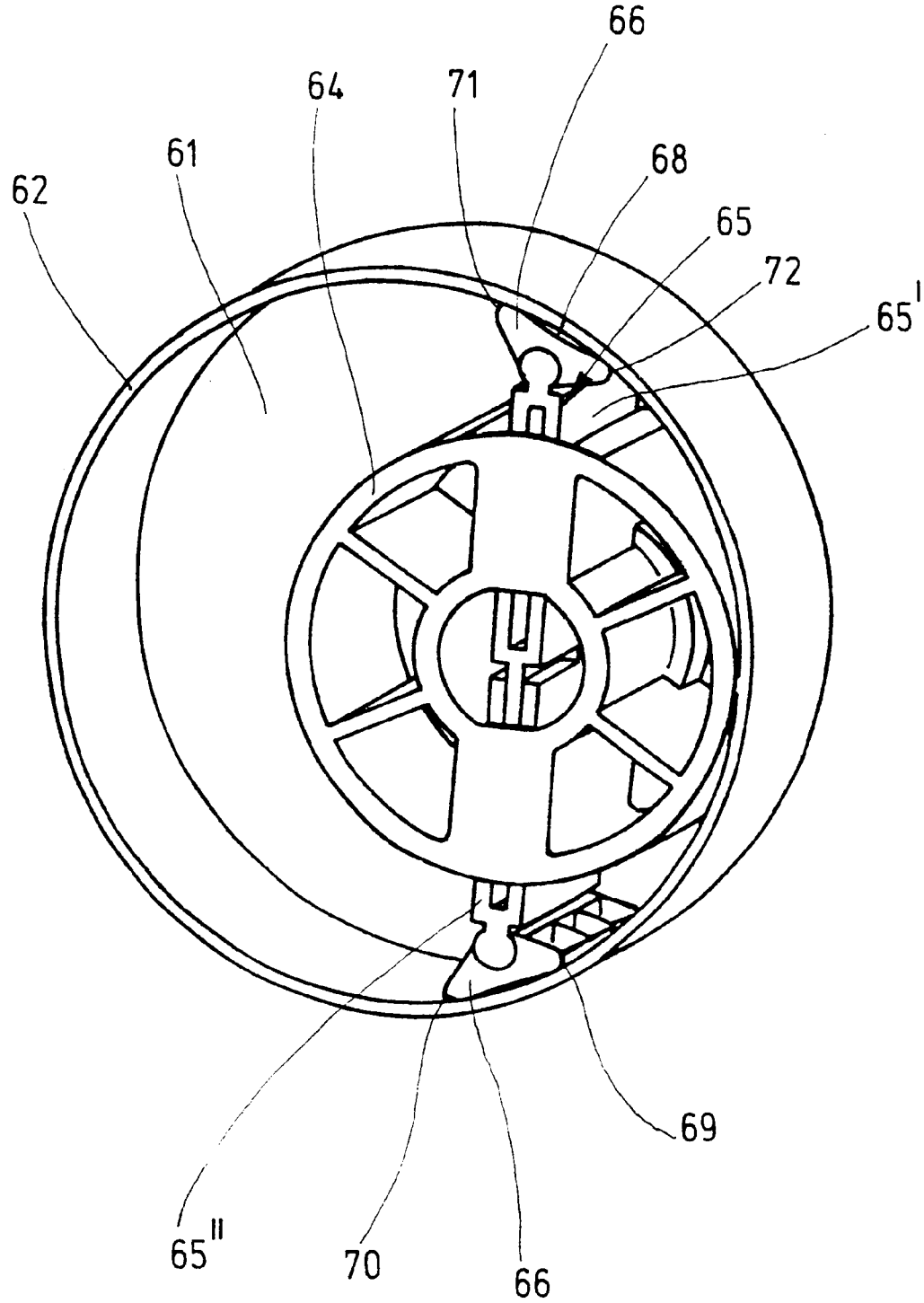
FIG. 5, a view into the interior of a positive-displacement pump, the vane of which represents another embodiment of the invention.
Figure 6:
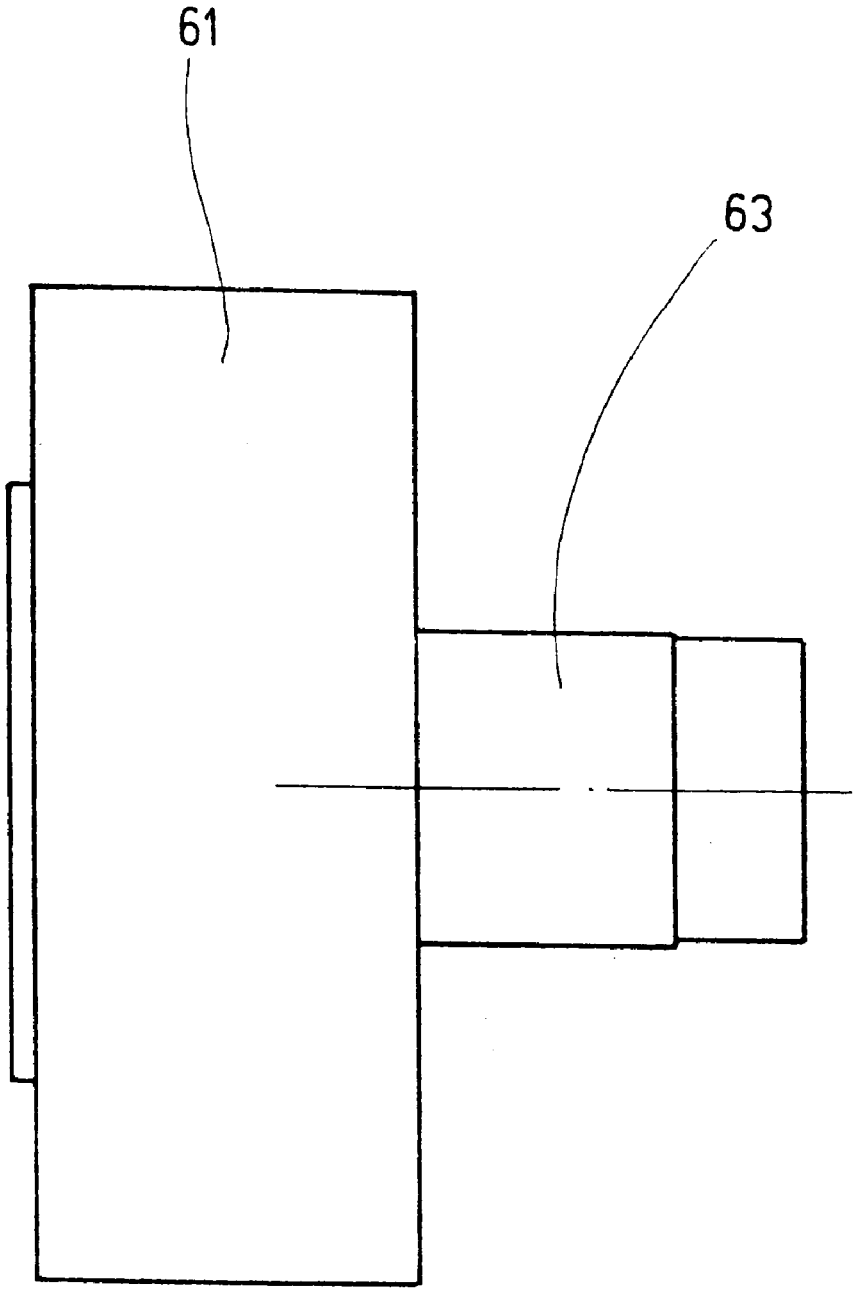
FIG. 6, a side view of a positive-displacement pump according to FIG. 5, and FIG. 7, a perspective representation of the pump vane that is formed by two partial vane elements.
Figure 7:
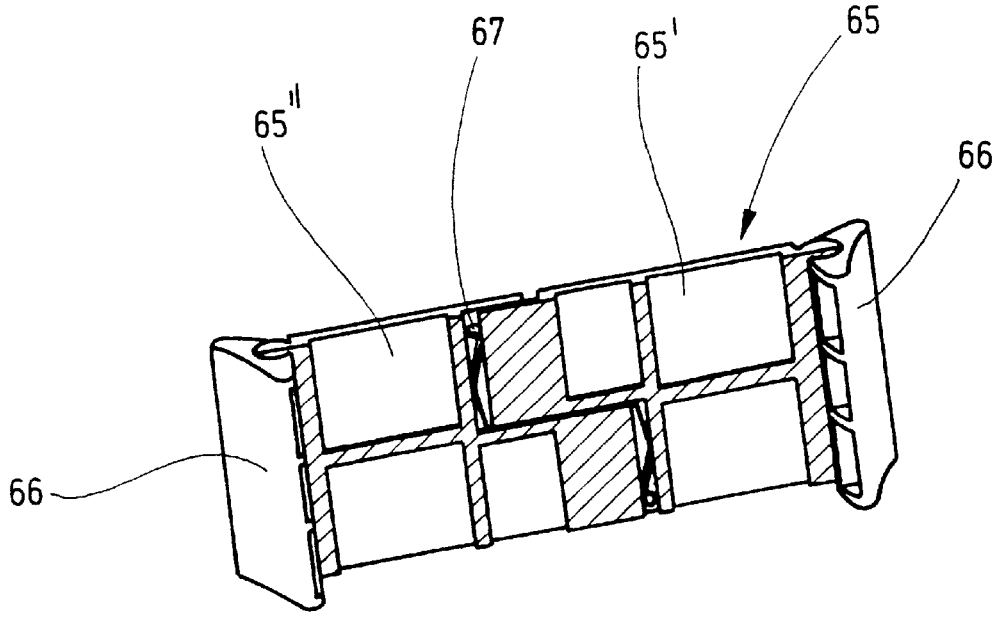

The positive-displacement pump according to FIGS. 5 and 6 contains a flange body with a cylindrical pot 62 that forms a pump housing 61, a pump drive shaft 63 that is arranged in the pump housing and contains an attached rotor 64 and a two-part vane that is identified by the reference symbol 65 and guided in a recess that extends over the rotor center. FIG. 7 shows that this vane is preferably formed by two flat, symmetrically stepped partial vane elements 65', 65" which respectively contain a pivot bearing on their outer end. A sealing strip 66 is arranged on this pivot bearing such that it can be pivoted about an axis that extends parallel to the rotational axis of the rotor.

The other end of the partial vane elements 65', 65" is designed in such a way that the elements are engaged with one another in a symmetrically, half-lap, flush fashion (see FIG. 7) or in the form of a tongue-and-groove arrangement (see FIG. 5).

Although not shown in the figures, a suitable compression spring needs to be positioned within the partial vane element 65" in the latter instance. In the former instance, a Z-shaped spring 67 is arranged between the two partial vane elements 65', 65" as shown in FIG. 7, wherein the end faces of the elements are respectively supported on one limb of the Z-shaped spring. This spring moves the two partial vane elements 65', 65" apart from one another such that the sealing strips 66 contact the inner circumference of the cylindrical pot 62 with a defined force.

The sealing strips 66 have a concave radius 68 toward the wall of the cylindrical pot 62 (FIG. 5). This results in two contact lines 69 and 70 that serve for sealing the chambers in front and behind the vane 65 in cooperation with the flat partial vane elements 65', 65". Radii 71 and 72 are provided on the ends of the sealing strips 66 such that an optimal subsequent sealing effect is achieved.

The rotor 64 is slotted toward the drive shaft 63 in order to guide the vane 65 and is attached, inserted or injection-molded into/onto the shaft 63.

During the rotation of the drive shaft 63, the two partial vane elements 65', 65" are able to radially move in the rotor 64 independently of one another. The ends (69 and 70) of the sealing strips 66 adjoin the inner circumference of the cylindrical pot 62 at any rotational angle and thusly change their angle of contact relative to the translational axis of the vane 65. Due to the fact that the sealing strips 66 are fixed in the pivot bearings of the partial vane elements 65', 65" and the fact that their angle of contact changes when the drive shaft 63 rotates, the axial distance between the two pivot bearings becomes variable in addition to the variable geometric size of the theoretical axial dimension in the vane axis when the sealing strips 66 adjoin the inner circumferential surface of the cylindrical pot 62.

This length change is compensated by the radial mobility of the partial vane elements 65', 65". The adaptation to the variable length in the respective angle of rotation is realized by pressing the sealing strips 66 against the inner circumferential surface and driving the vane 65 by the drive shaft 63 via the spring 67 or a corresponding compression spring that presses the partial vane elements 65', 65" apart from one another and consequently presses the sealing strips 66 connected to these partial vane elements against the wall of the cylindrical pot.

The rotor vane 18; 65, the partial vane elements 65', 65", the sealing strips 20, 22; 66 and the rotor 28; 64 can be advantageously manufactured from metal, plastic, ceramic, a metal-plastic combination, a metal-ceramic combination, a metal-plastic-ceramic combination or a plastic-ceramic combination.

With respect to plastic materials, polyether ether ketone (PEEK), polyether sulfide (PES), syndiotactic polystyrene (SPS) and polyphenylene sulfide (PPS) are preferably utilized.

I claim:

1. Positive-displacement pump, comprising:

a vane for mutually separating two chambers in a housing interior wherein the vane is driven by a drive shaft that is arranged in the pump housing and guided such that it can be radially displaced relative to the drive shaft in a plane that contains the drive shaft axis, wherein the respective ends of the vane carry sealing strips that adjoin the inner circumferential wall of the housing interior in a sealing fashion and can be radially moved relative to the axis of the drive shaft independently of one another, at least one energy storing device engaging the vane, wherein said energy storing device constantly holds both sealing strips in sealing contact with the inner circumferential wall of the housing interior, wherein the vane includes two vane elements each of which include symmetrically stepped end faces, wherein each end face engages the other end face in a half-lap fashion, and wherein the end faces are respectively supported on one limb of a Z-shaped spring that is inserted between the end faces.

2. Positive-displacement pump according to claim 1, wherein the vane is guided in a slot of a rotor that is arranged in the housing interior and driven by the drive shaft, with said slot symmetrically lying in a plane that contains the rotor axis, wherein the sealing strips which contact the inner circumferential surface of the housing interior are movably arranged on the vane ends, and wherein the vane is formed by two partial vane elements that lie flush relative to one another and can be moved independently of one another, with the energy storing device being arranged between the partial vane elements.

3. Positive-displacement pump according to claim 2, wherein the partial vane elements are realized symmetrically.

4. Positive-displacement pump according to claim 3, wherein the partial vane elements have a flat profile.

5. Positive-displacement pump according to claim 2, wherein the sealing strips are, as viewed in the circumferential direction, in a two-line contact with the inner circumferential surface of the housing interior.

6. Positive-displacement pump according to claim 5, wherein the side of the sealing strips which faces the inner circumferential surface is curved in a concave fashion in the circumferential direction of the housing interior.

7. Positive-displacement pump according to claim 2, wherein the cylindrical inner circumferential surface of the housing interior has an oval shape.

* * * * *